US009964357B2

(12) United States Patent
Zhao et al.

(10) Patent No.: US 9,964,357 B2
(45) Date of Patent: May 8, 2018

(54) DRYING AND SEPARATION INTEGRATED MACHINE FOR VIBRATING FLUIDIZED BED

(71) Applicant: CHINA UNIVERSITY OF MINING AND TECHNOLOGY, Jiangsu (CN)

(72) Inventors: Yuemin Zhao, Jiangsu (CN); Xuliang Yang, Jiangsu (CN); Pengfei Zhao, Jiangsu (CN); Zhenfu Luo, Jiangsu (CN); Zengqiang Chen, Jiangsu (CN); Chenlong Duan, Jiangsu (CN); Shulei Song, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 269 days.

(21) Appl. No.: 14/780,688

(22) PCT Filed: Jul. 26, 2013

(86) PCT No.: PCT/CN2013/080193

§ 371 (c)(1),
(2) Date: Sep. 28, 2015

(87) PCT Pub. No.: WO2014/161253

PCT Pub. Date: Oct. 9, 2014

(65) Prior Publication Data

US 2016/0054056 A1 Feb. 25, 2016

(30) Foreign Application Priority Data

Apr. 2, 2013 (CN) ..... 2013 1 0111529

(51) Int. Cl.
*F26B 3/092* (2006.01)
*B03B 4/02* (2006.01)

(52) U.S. Cl.
CPC ..... *F26B 3/0923* (2013.01); *B03B 4/02* (2013.01)

(58) Field of Classification Search
CPC .. F26B 11/0431; F26B 25/002; F26B 17/103; F26B 17/26; F26B 17/006; F26B 3/092;
(Continued)

(56) References Cited

U.S. PATENT DOCUMENTS 2,651,565 A * 9/1953 Bergman ..... B01J 8/44 34/583
2,782,019 A * 2/1957 Turney ..... B01J 8/1836 165/104.16

(Continued)

FOREIGN PATENT DOCUMENTS

CN 1046102 C 11/1999
CN 201203330 Y 3/2009

(Continued)

*Primary Examiner* — Jessica Yuen
(74) *Attorney, Agent, or Firm* — Saliwanchik, Lloyd & Eisenschenk

(57) ABSTRACT

Drying and separation vibrating fluidized bed for processing wet coal by high-temperature hot air. Wet coal is fed into a vibrating separation chamber connected to a hot air supply duct. The wet coal is vibrated as it is dried and is layered as heat and mass transfer occur between the high-temperature air and the wet coal particles. Hot air enters the bottom of separation chamber through a distribution plate that includes asbestos fiber cloth sandwiched between clamping plates. The wet coal is fed through a feeding distribution device that separates the coal pieces as they enter the separation chamber. After the coal is dried and layered, the heavy and light material exits the separation chamber through two discharge impellers.

5 Claims, 2 Drawing Sheets

(58) Field of Classification Search
CPC .... F26B 3/00; F26B 9/00; F26B 9/066; F26B 9/08; F26B 9/003; F26B 3/0923; B01J 8/0015; B01J 8/18; B01J 2204/002; B01J 2208/00752; B03B 4/00; B03B 4/02; B03B 4/08; B07B 11/00; B07B 11/06; B07B 9/02; B07B 9/00
USPC ... 34/60, 164, 401, 509, 262, 368, 513, 586, 34/588, 236; 414/199, 299; 110/224, 110/232, 222, 243–245; 193/2 R, 3, 4, 193/20, 21
See application file for complete search history.

(56) References Cited

U.S. PATENT DOCUMENTS 3,299,947 A * 1/1967 Boucraut ..... C22B 1/10 165/164
3,851,405 A * 12/1974 Furukawa ..... F26B 3/08 165/104.16
4,793,918 A * 12/1988 Thomas ..... B03B 4/02 209/467
5,546,875 A * 8/1996 Selle ..... C10L 9/08 110/245
6,135,020 A * 10/2000 Broyles ..... A23N 5/01 426/481

FOREIGN PATENT DOCUMENTS

| | | | |
|---|---|---|---|
| CN | 102652940 | A | 9/2012 |
| CN | 102921636 | A | 2/2013 |
| CN | 103196281 | A | 7/2013 |
| JP | H 1151314 | A | 2/1999 |
| WO | WO 2008/138818 | A1 | 11/2008 |

* cited by examiner

DRYING AND SEPARATION INTEGRATED MACHINE FOR VIBRATING FLUIDIZED BED

CROSS REFERENCE TO A RELATED APPLICATION

This application is a National Stage Application of International Application Number PCT/CN2013/080193, filed Jul. 26, 2013; which claims priority to Chinese Patent Application No. 201310111529.6, filed Apr. 2, 2013; both of which are incorporated herein by reference in their entirety.

TECHNICAL FIELD

The present invention relates to a coal upgrading apparatus, in particular to an apparatus that dries and separates lignitous coal, low-rank coal, and other low-quality wet coal at the same time in a vibrating fluidized bed and thereby accomplishes de-ashing and dehydration of coal through a dry process.

BACKGROUND OF THE INVENTION

At present, low-quality coal, typically lignitous coal and low-rank coal, is abundant in reserve but is severely limited in application owing to its high moisture content and low heat value, etc., and has low efficiency and severe pollution during utilization, thus is in contradiction to the increasingly strict energy conservation and environment protection requirements in China. There is an urgent need for developing more efficient and reliable low-quality coal upgrading technology and equipment. Presently, air dense-medium fluidized beds and air dense-medium fluidized beds with an external force field can accomplish high efficient separation of low-moisture coal, but the dense medium particles may cohere and agglomerate under the impact of more external moisture and thereby may severely degrade fluidization performance of the fluidized bed owing to the fine granularity of the dense medium particles. Hence, these fluidized beds cannot carry out separation of low-quality coal that contains high moisture directly. Furthermore, even though a pre-drying procedure is introduced, large particles of low-quality coal (especially lignitous coal) may crack and form a large quantity of coal dust during the drying process. When the coal dust is mixed into the dense medium, not only the coal dust itself can't be separated, but also the density stability of the separation bed layer is severely degraded, thus the separation effect will get worse.

SUMMARY OF THE INVENTION

Technical Problem

The object of the present invention is to overcome the drawbacks in the prior art by providing an drying and separation integrated machine for vibrating fluidized bed, which introduces high-temperature hot air into a vibrating fluidized bed, integrates drying and separation procedures and thereby accomplishes synergistic de-ashing and dehydration and upgrading of low-quality coal, and the features of which rest with simple structure, stable operation, high reliability, low separation cost, high efficiency and environmental protection, etc.

Technical Scheme

The drying and separation integrated machine for vibrating fluidized bed provided in the present invention comprises a front rack, a rear rack, a separation bed, and an impeller feeder disposed on the upper part at the front end of the separation bed, wherein, a waste-rock impeller discharger and a fine-coal impeller discharger are disposed at the tail end of the separation bed, a dust-removing and air-inducing hood is disposed on the upper part of the separation bed, an air distribution chamber is disposed on the bottom of the separation bed, an air distribution plate is disposed on the upper part of the air distribution chamber, the front rack and rear rack are connected to the separation bed via a spring and a spring support; a hydraulic cylinder is disposed on the bottom of the rear rack so that the inclination angle of the separation bed is adjustable within a range of −10° to +10°; a feeding distribution device is disposed on the lower part of the impeller feeder, fixed to the separation bed and flexibly connected with the impeller feeder; the feeding distribution device comprises a chute, with three rows of steel bars being arranged in a crisscross pattern at an interval in the chute; two dust-removing and air-inducing hoods and two air distribution chambers are provided on the top and the bottom of the separation bed respectively, the dust-removing and air-inducing hood and air distribution chamber are coated with a heat-insulating coating having a thickness of 2-3 mm on their outer surface respectively, and a separating eccentric shaft vibration exciter is disposed on the lower part at the front end of the separation bed; the air distribution plate is composed of upper and lower porous metal clamping plates and asbestos-fiber filter cloth sandwiched between the porous metal clamping plates; an air separator is provided on the bottom of each of the two air distribution chambers respectively, is connected to a hot air duct coated with a heat insulating coating, and is composed of a flow deflection plate and a flow restriction plate; the hot air duct connected with the air separator is provided with a flow meter and a control valve designed to control the air flow into the air distribution chamber.

A baffle plate that can move up and down is disposed on the front part of the fine-coal impeller discharger; a frequency conversion and constant pressure controller is disposed at the inlet of the hot air duct to control the error of air inflow into the air distribution chamber within a range of ±4%.

Beneficial Effects

The wet coal in the vibrating fluidized bed is fluidized by hot air in the present application, heat transfer and mass transfer occur between the high-temperature air and the wet coal particles, and the moisture in the coal is taken out of the fluidized bed by the fluidizing air in the form of water vapor and thereby dehydration and upgrading of coal is achieved. In the drying process, the coal particles are fluidized by synergistic action of air flow and vibration and settle under interference in a dilute-phase zone created by a bubbling behavior; finally, high-density waste rocks settle down to the bottom of the bed while low-density fine coal floats up to the top of the bed, and then discharge devices are used to carry out layered collection, to obtain fine coal and waste rocks. The low-quality coal with high moisture content is fluidized by hot air in the vibrating fluidized bed, the input material is separated under appropriate vibration conditions at an appropriate operation air flow rate so as to be fluidized uniformly and stably, heat transfer and mass transfer with high efficiency occur between the high-temperature air flow and the coal particles with high moisture content inside the fluidized bed, and the liquid water is gradual changed into water vapor which enters into a dust separator along with the ascending air flow; thus, the moisture in the separated input material is removed; at the same time, the separated input material settles under interference in the fluidized bed under the double actions of vibration and air flow, high-density waste rocks settle down to the lower part of the bed while low-density fine coal floats up to the upper part of the bed, and efficient laying is achieved within the range of certain separation length; the waste rocks and fine coal are discharged by a waste rock discharge device and a fine coal discharge device disposed at the rear end of the separation bed respectively, to obtain waste rock and fine coal products and accomplish de-ashing and upgrading of low-quality coal. The transport speed of the material to be separated in the separation bed can be adjusted by adjusting the vibration direction angle and/or the inclination angle of the bed. No dense medium is utilized during the entire drying and separation process, and the processing cost is low. The separation machine can separate lignitous coal, low-rank coal, and other wet coal while drying them, discharge high ash waste rocks, achieve de-aching and dehydration of the coal, and thereby increase the coal quality, so that low-quality coal can be utilized in an efficient and clean manner. The machine is especially suitable for upgrading of low-quality coal with high moisture content, such as lignitous coal and low-rank coal, etc. The machine has a simple structure and high reliability, can operate stably, and has wide practicability.

Among the figures: 1—impeller feeder, 2—feeding distribution device, 3—air distribution chamber, 4—dust-removing and air-inducing hood, 5—air separator, 6—separation bed, 7—baffle plate, 8—fine-coal impeller discharger, 9—eccentric shaft vibration exciter, 10—front rack, 11—flow meter, 12—rear rack, 13—hydraulic cylinder, 14—waste-rock impeller discharger, 15—air distribution plate, 16—spring support, 17—spring, 18—control valve, 19—hot air duct, 20—chute, 21—steel bar.

EMBODIMENTS

Figure 1:
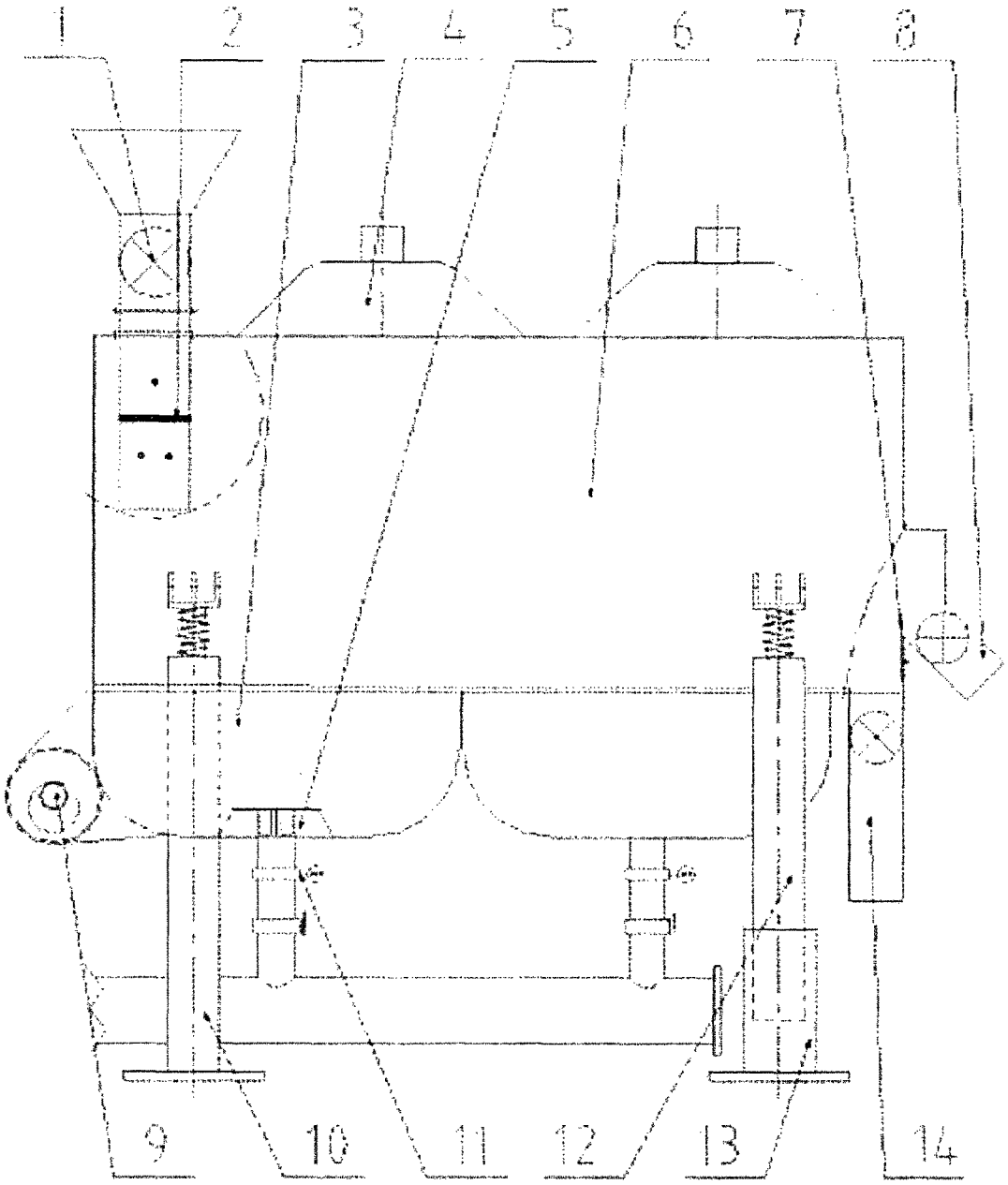
FIG. 1 is a front view of the structure in the present invention.
Figure 2:
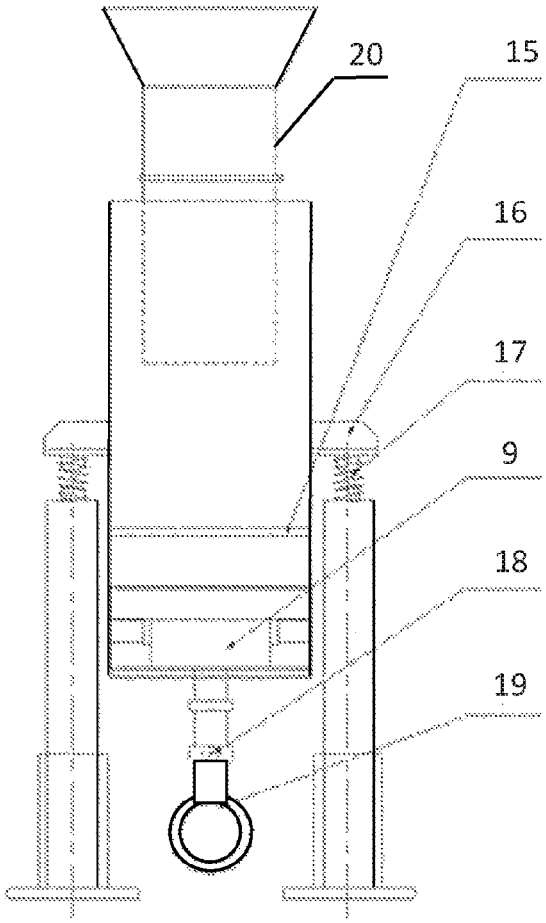
FIG. 2 is a right view of the structure in the present invention.
Figure 3:
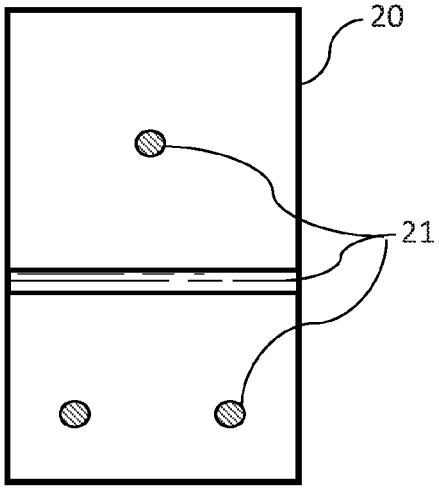
FIG. 3 is a schematic structural diagram of the input material separator.
Figure 4:
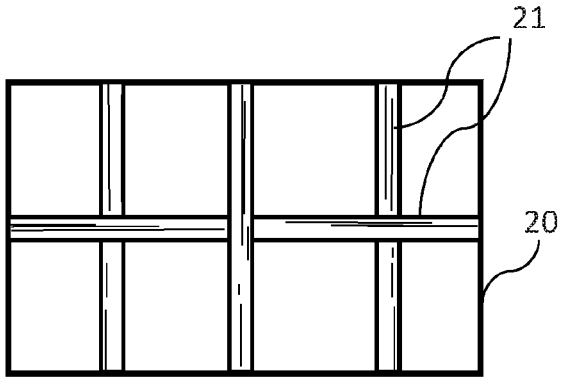
FIG. 4 is a top view of the structure shown in FIG. 3.

Hereunder an embodiment of the present invention will be further described in detail with reference to the accompanying drawings:

As shown in FIGS. 1, 2, and 3, the drying and separation integrated machine for vibrating fluidized bed provided in the present invention mainly comprises a separation bed 6, a front rack 10, a rear rack 12, an air distribution chamber 3, an eccentric shaft vibration exciter 9, a waste-rock impeller discharger 14 and a fine-coal impeller discharger 8. A impeller feeder 1 is disposed on the upper part at the front end of the separation bed 6, a waste-rock impeller discharger 14 and a fine-coal impeller discharger 8 are disposed at the tail end of the separation bed 6; a dust-removing and air-inducing hood 4 is disposed on the upper part of the separation bed 6, an air distribution chamber 3 is disposed on the bottom of the separation bed 6, an air distribution plate 15 is disposed on the upper part of the air distribution chamber 3, the front rack 10 and rear rack 12 are connected to the separation bed 6 via a spring 17 and a spring support 16; a hydraulic cylinder 13 is disposed on the bottom of the rear rack 12 so that the inclination angle of the separation bed 6 is adjustable within a range of −10° to +10°; the inclination angle of the separation bed 6 is adjustable within a range of −10° to +10° by adjusting the height of the rear rack 12 with the hydraulic cylinder 13; a feeding distribution device 2 is disposed on the lower part of the impeller feeder 1, and fixed to the separation bed 6; the feeding distribution device 2 is flexibly connected with the impeller feeder 1, and rigidly connected with the separation bed 6; the feeding distribution device 2 comprises a chute 20, with three rows of steel bars 21 being arranged in a crisscross pattern at interval in the chute 20, to break up the large-block material formed under the squeezing action of the impeller feeder 1; two dust-removing and air-inducing hoods 4 and two air distribution chambers 3 are provided on the top and the bottom of the separation bed 6 respectively, the dust-removing and air-inducing hood 4 and air distribution chamber 3 are coated with a heat-insulating coating having a thickness of 2-3 mm on their outer surface respectively, and a separating eccentric shaft vibration exciter 9 is disposed on the lower part at the front end of the separation bed 6; the air distribution plate 15 is composed of upper and lower porous metal clamping plates and asbestos-fiber filter cloth sandwiched between the porous metal clamping plates; an air separator 5 composed of a flow deflection plate and a flow restriction plate is disposed on the bottom of the two air distribution chambers 3 respectively, to promote uniform distribution of the hot air across the entire section of the air distribution chamber; the air separator 5 is connected to a hot air duct 19 coated with a heat insulating coating; a frequency conversion and constant pressure controller is disposed at the inlet of the hot air duct 19 to control the error of air inflow volume into the air distribution chamber 3 within a range of ±4%, and the frequency conversion and constant pressure controller comprises a pressure sensor, a microcomputer processing module that receives signals from the pressure sensor, and a frequency converter that controls the rotation speed of a fan, wherein the control signal from the microcomputer processing module is received by the frequency converter, so as to meet the demand for air supply of the hot air duct 19 at a constant pressure and a variable flow rate. The hot air duct 19 connected with the air separator 5 is provided with a flow meter 11 and a control valve 18 designed to control the air inflow volume into the air distribution chamber 3 so as to independently adjust air speed in sections in the direction of separation length. A baffle plate 7 that can move up and down is arranged on the front part of the fine-coal impeller discharger 8 and is connected with the separation bed 6 by threaded connection, so that the material blocking height is adjusted by adjusting a bolt to move the baffle plate 7 up or down in a fixed strip slot.

Operating Process:

the high-temperature hot air in the hot air duct 19 flows through the control valve 18 and flow meter 11 into the air distribution chamber 3, and uniformly passes through the air distribution plate 15 into the separation bed 6 by the air separator 5; at the same time, the input material is fed by the impeller feeder 1 into the feeding distribution device 2, and then the diffuse input material is fed into the separation bed 6 and is fluidized under the synergistic action of vibration and high-temperature hot air. Highly-efficient heat transfer and mass transfer occur between the particles of input material and the high-temperature hot air, and the moisture is taken out of the separation bed by the ascending air flow in the form of water vapor into a dust separator, where dust is collected and clean air with residual heat is discharged for recirculation. As the moisture in the input material is removed, material layering based on a interfered settling process is realized in the vibrating fluidized bed, the waste rocks settle downward, while the fine coal floats upward, and the waste rocks and fine coal are discharged respectively by the waste-rock impeller discharger 14 and fine-coal impeller discharger 8 disposed at the tail end of the separation bed; thus, a de-ashing process is completed and separation is achieved. The quality and quantity of the fine coal product can be controlled by means of the baffle plate 7 disposed on the front part of the fine-coal impeller discharger 8.

The invention claimed is:

1. A drying and separation integrated machine for a vibrating fluidized bed, comprising a front rack, a rear rack, a separation bed, and an impeller feeder disposed on an upper part at a front end of the separation bed for receiving high-moisture, large-block material, a waste-rock impeller discharger and a fine-coal impeller discharger disposed at a tail end of the separation bed for discharging dried material, two dust-removing and air-inducing hoods disposed on an upper part of the separation bed, each having an exterior heat-insulating coating, two air distribution chambers disposed on a bottom of the separation bed, each having an exterior heat-insulating coating; an air distribution plate disposed on an upper part of the two air distribution chambers, the air distribution plate comprising an asbestos-fiber filter between upper and lower porous metal clamping plates; wherein the front rack and rear rack are connected to the separation bed via a spring and a spring support, the rear rack further comprising a hydraulic cylinder on the bottom of the rear rack so that an inclination angle of the separation bed is adjustable within a range of −10° to +10°; a feeding distribution device disposed between the impeller feeder and the separation bed, wherein the feeding distribution device comprises a chute with three rows of bars being arranged at intervals in a crisscross pattern in the chute, positioned to break-up material as it passes over the bars towards the separation bed; an eccentric shaft vibration exciter disposed on the lower part at the front end of the separation bed; an air separator comprising a flow deflection plate and a flow restriction plate disposed on each of the two air distribution chambers, each air separator being operably connected to a hot air duct, for providing high-temperature air to the separation bed through the two air distribution chambers, the hot air duct having a heat insulating coating and further comprising a flow meter and a control valve to control the high-temperature air flow into the two air distribution chambers.

2. The drying and separation integrated machine according to claim 1, further comprising a baffle plate disposed on the front part of the fine-coal impeller discharger.

3. The drying and separation integrated machine according to claim 1, wherein, a frequency conversion and constant pressure controller is disposed at the inlet of the hot air duct to control an error of air inflow volume into the air distribution chamber within a range of ±4%.

4. The drying and separation integrated machine, according to claim 1, wherein the heat-insulating coating is 2-3 mm in thickness.

5. The drying and separation integrated machine, according to claim 1, wherein the bars are steel.

* * * * *